US006478497B2

(12) United States Patent
Villahoz

(10) Patent No.: US 6,478,497 B2
(45) Date of Patent: Nov. 12, 2002

(54) APPLICATOR FOR FOOTWEAR

(76) Inventor: Maria Inmaculada Nieto Villahoz, Paseo Ondarreta, 5-2°, C, San Sebastian (ES)

( * ) Notice: Subject to any disclaimer, the term of this patent is extended or adjusted under 35 U.S.C. 154(b) by 0 days.

(21) Appl. No.: 10/026,015

(22) Filed: Dec. 21, 2001

(65) Prior Publication Data

US 2002/0051672 A1 May 2, 2002

Related U.S. Application Data

(63) Continuation-in-part of application No. 09/630,848, filed on Aug. 2, 2000, now abandoned.

(30) Foreign Application Priority Data

Feb. 22, 2000 (ES) ..... 200000438 U

(51) Int. Cl.[7] ..... B43K 5/00

(52) U.S. Cl. ..... 401/206; 401/205; 401/18; 401/202; 401/264; 401/37

(58) Field of Search ..... 401/206, 205, 401/264, 263, 262, 18, 19, 37, 38, 202

(56) References Cited

U.S. PATENT DOCUMENTS

| | | | | | |
|---|---|---|---|---|---|
| 2,974,350 | A | * | 3/1961 | Schwartzman | 401/206 |
| 3,010,140 | A | * | 11/1961 | Thomas | 401/262 |
| 3,187,364 | A | * | 6/1965 | Dake, Jr. et al. | 401/38 |
| 3,805,990 | A | * | 4/1974 | Palaudarias | 401/206 |
| 5,865,554 | A | * | 2/1999 | Lin | 401/206 |

* cited by examiner

*Primary Examiner*—David J. Walczak
(74) *Attorney, Agent, or Firm*—Brown & Michaels, PC.

(57) ABSTRACT

An applicator for footwear, including a receptacle for containing a cleaning product and/or a polishing product. A first cover is mounted to the receptacle with a cleaning device coupled to the cover. At least one valve for delivering the cleaning product or polishing product from the receptacle to the cleaning device is fitted into the first cover and extends to a base of the receptacle. A second cover is adapted to cover the cleaning device. The second cover includes a sponge coupled to an outer surface of the cover and a lid to cover the sponge.

6 Claims, 2 Drawing Sheets

APPLICATOR FOR FOOTWEAR

RELATED APPLICATION

This is a continuation in part of Ser. No. 09/630,848, filed Aug. 2, 2000.

BACKGROUND OF THE INVENTION

The present invention relates to an applicator for cleaning and/or polishing footwear. The applicator includes a receptacle containing a cleaning and/or polishing product, and a cleaning device includes spongy materials or equivalent products which, on passing over the footwear, cleans the footwear and optionally impregnates the footwear with the cleaning or polishing product contained in the receptacle.

Applicators of similar characteristics are common on the market. Generally, in all cases it is necessary to squeeze the flexible receptacle to empty part of its contents into the cleaning component. Also, another component is known which includes a sponge generally impregnated with a polishing product and lacking an attached receptacle, which is used only for occasional cleaning since the duration of the polish is very limited.

The applicator mentioned here has a body defining a generally flat surface to which a cover is coupled. The cover includes a cylindrical housing incorporating a valve. The cylindrical housing of the cover fits into an orifice in an equivalent shape defined in the receptacle. Upon being pressed, the valve in the applicator over the footwear permits the product to exit.

When a sport footwear is considered, the cleaning device has an internal spongy material and a harder and rougher outside material, like a swab, that allows deeper cleaning to be performed.

Likewise, this applicator has a cover on the outside that has a complimentary sponge that is similarly applicable to the cleaning and polishing of the footwear. In turn, this cover is also provided with a lid which covers the complementary sponge.

BRIEF DESCRIPTION OF THE DRAWINGS

The object of the present invention will be understood better by means of the following specification based on a practical example of an embodiment. This description is made on the basis of the attached plan drawings, where.

DETAILED DESCRIPTION OF THE PREFERRED EMBODIMENTS

Figure 1A:
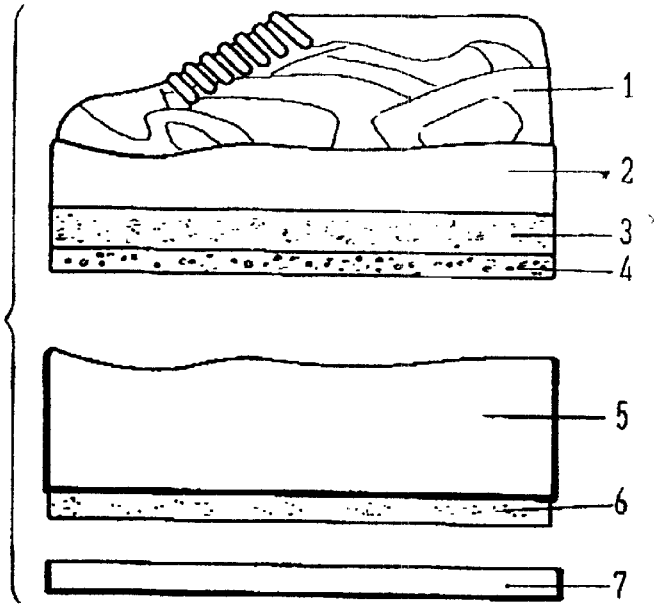
FIGS. 1A and 1B show two side views of the applicator for footwear of the invention.
Figure 1B:
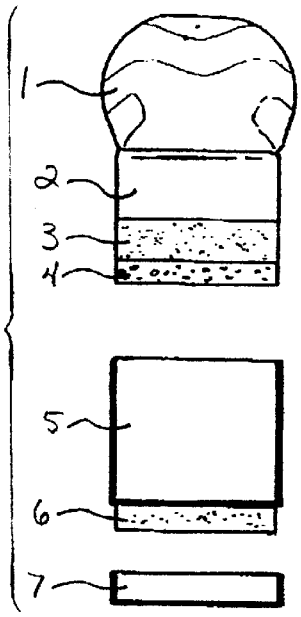

Referring to FIGS. 1A–1B, the applicator comprises a receptacle (1) for containing a product, such as a liquid cleaning or polishing product. The receptacle includes a generally flat, longitudinal face to which a first cover (2) is mounted. Referring to FIGS. 2A, 2C, 3, 4 and 5, the first cover (2) includes at least one product delivery valve (8) fitted into a housing having a cylindrical shape (17). The cylindrical shaped housing (17) is introduced into an orifice (12) which is located in a matching protruding knob (11) of the face of the receptacle (1), in this way establishing a joint between both parts.

An outside face of the first cover (2) includes a cleaning device having, especially when used for cleaning sports footwear a spongy internal material (3) and a harder material (4) exterior to the internal material, the harder material having a composition similar to a stiff swab.

Referring to FIGS. 1A and 1B, the applicator also includes a second cover (5) that is adapted to cover the cleaning device. An outside surface of the second cover (5) includes a complementary sponge (6) which is also adapted for the cleaning and polishing of footwear. In this case, a lid (7) is included to cover the complementary sponge (6).

Figure 2A:
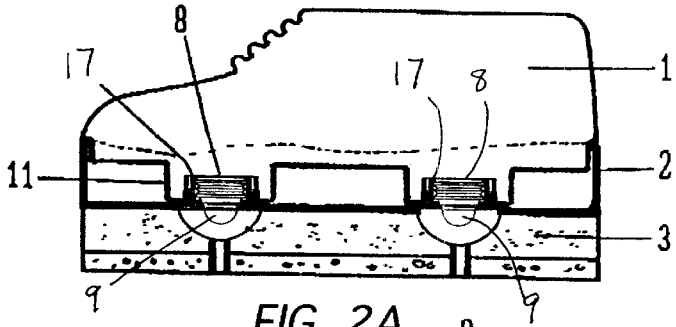
FIGS. 2A, 2B and 2C show sectioned elevation, profile and plan views of the applicator for footwear of the invention.
Figure 2C:
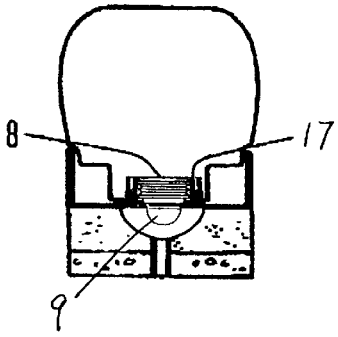
Figure 2B:
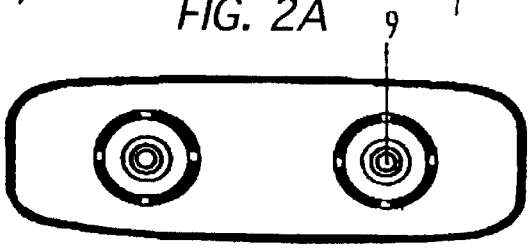

In reference to FIGS. 2*a*–2*c*, 3, 4 and 5, one or more product delivery valves (8) are provided (two valves are depicted in FIGS. 2*a* and 2*b*) for permitting the controlled dispensing of the cleaning product or polishing product from the receptacle (1) and into the cleaning device (3) and (4). The one or more valves (8) are each fitted into a corresponding cylindrical housing (17) within the first cover (2).

Figure 3:
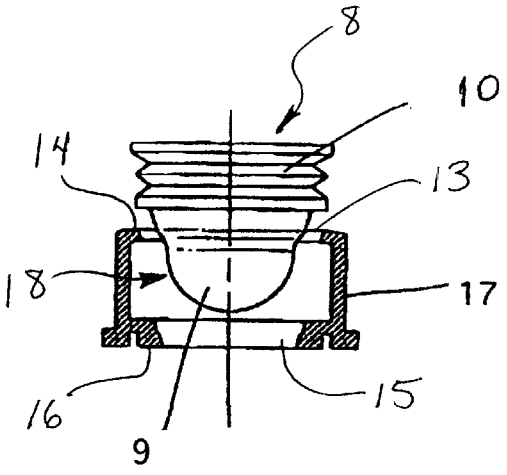
FIG. 3 is an exploded view of a product delivery valve of the applicator for footwear of the invention.
Figure 4:
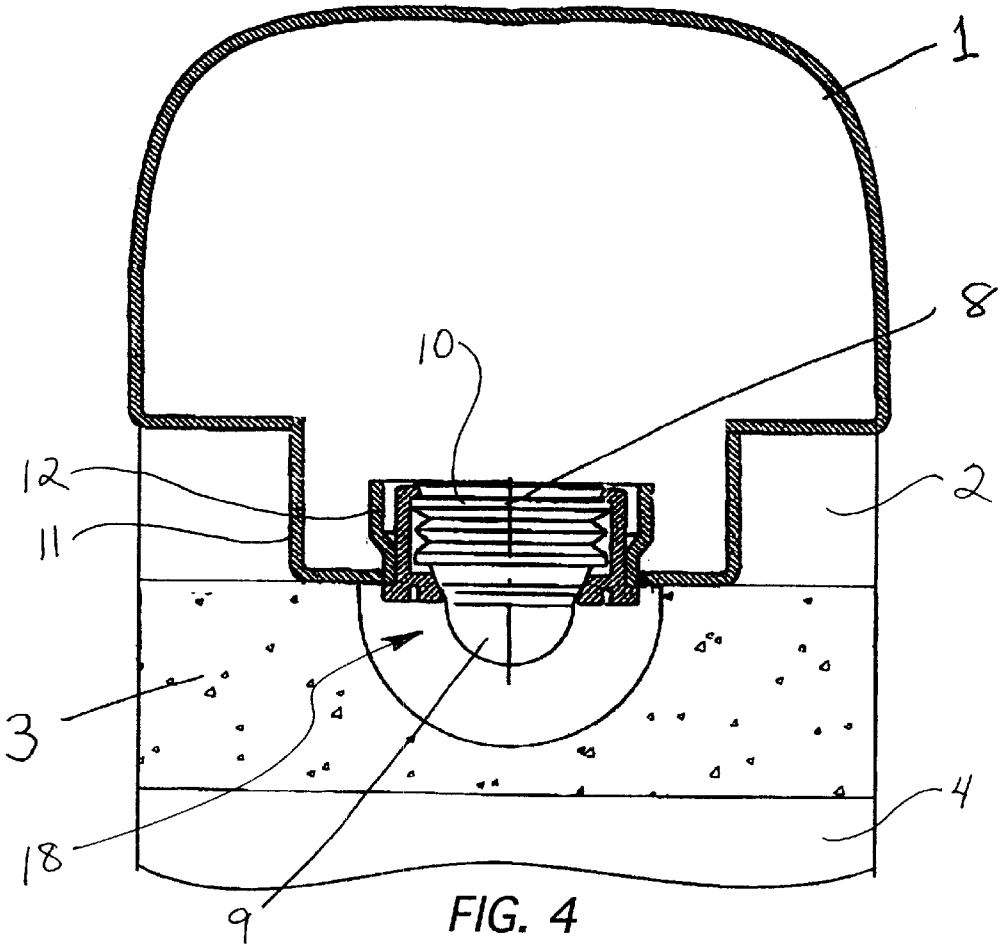
FIG. 4 is a sectional view of the applicator for footwear of the invention showing the product delivery valve.

Referring to FIG. 4, the receptacle (1) has a cylindrical orifice (12) in which the cylindrical housing (17) for the valve (8) is mounted, such as by adhesive or heat sealing, for example. Referring to FIGS. 3 and 4, the cylindrical housing (17) of the valve is open at both ends, having an upper orifice (13) with an upper inner annular flange (14) and a lower orifice (15) with a lower inner annular flange (16). The valve sealing element (18) is introduced into, and trapped within, the cylindrical housing (17), between the upper and lower inner flanges (14) and (16). The valve sealing element (18) includes a hemispherical outer sealing end (9), and a bellows portion (10) facing toward the receptacle (1). The bellows portion (10) has a spring bias expanding the bellows portion to normally cause the valve sealing element (18) to seal the lower orifice (15) of the valve to maintain the valve closed. On pressing the applicator over the surface of the footwear to be cleaned, the hemispherical part (9) of the valve is compressed, pressing the bellows (10), permitting the exit of the product through the corresponding conduit that exists between the body of the valve and its housing (17).

Figure 5:
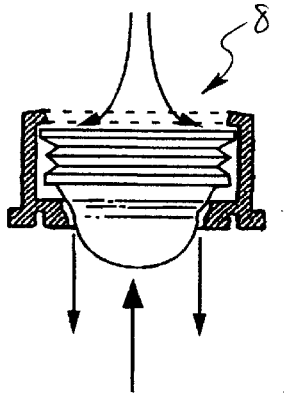
FIG. 5 is a sectional view of the applicator for footwear of the invention showing operation of the product delivery valve.

As is illustrated in FIG. 5, when the hemispherical outer sealing end (9) is pushed, the receptacle is squeezed, such as by application of pressure manually on the receptacle, the bellows (10) is compressed, moving the bellows (10) away from the upper orifice (13), allowing the liquid cleaning or polishing product to flow around the bellows (10). The valve sealing element (18) also moves away from the lower valve orifice (15), so that the liquid contained in the receptacle (1) is released to the outlet, soaking the sponge (3).

What is claimed is:

1. An applicator for applying a product, such as a cleaning product or a polishing product, to footwear, the applicator comprising:

a receptacle for housing the product, the receptacle having a lower flat face extending in a longitudinal direction, and at least one knob protruding from the face of the receptacle;

a first cover mounted to the flat face of the receptacle, the first cover having at least one cylindrical housing which protrudes into a hole located in the at least one knob of the receptacle;

a cleaning device coupled to an outside face of the first cover;

at least one product delivery valve fitted within the at least one cylindrical housing of the first cover such that an exit conduit exists between the valve and housing; and a second cover adapted to cover the cleaning device.

2. The applicator of claim 1, wherein the cleaning device comprises a spongy material.

3. The applicator of claim 1, wherein the cleaning device comprises a stiff swab.

4. The applicator of claim 1, the cleaning device comprising:

an internal spongy material; and a harder and rougher material coupled to the internal spongy material.

5. The applicator of claim 1, wherein the valve comprises a valve sealing element blocking the cleaning product or a polishing product from flowing through the exit conduit except when the valve is pressed inwardly when the applicator is applied against the footwear.

6. The applicator of claim 1, the second cover comprising:

a sponge coupled to an outer surface of the second cover; and a lid adapted to cover the sponge.

* * * * *